United States Patent [19]

Greenwald et al.

[11] 4,156,501

[45] May 29, 1979

[54] CYLINDRICAL MONEY BOX ASSEMBLY

[75] Inventors: Harry Greenwald, Whitestone; Anthony LiCausi, Maspeth, both of N.Y.

[73] Assignee: Walter Kidde & Company, Inc., Clifton, N.J.

[21] Appl. No.: 858,545

[22] Filed: Dec. 8, 1977

[51] Int. Cl.[2] ..... E05B 65/44

[52] U.S. Cl. ..... 232/1 R; 232/15; 70/168

[58] Field of Search ..... 232/15, 16; 70/63, 167, 70/168, 169, 85, 86, 87; 292/218

[56] References Cited

U.S. PATENT DOCUMENTS

| | | | |
|---|---|---|---|
| 998,194 | 7/1911 | McGloudy | 232/16 |
| 1,239,704 | 9/1917 | Lee et al. | 70/168 X |
| 1,567,881 | 12/1925 | Weber | 70/168 |
| 1,885,547 | 11/1932 | Rider | 70/168 |
| 3,538,724 | 11/1970 | Davenbaugh | 232/15 X |
| 3,871,284 | 7/1973 | Krise | 232/15 |

FOREIGN PATENT DOCUMENTS

| | | | |
|---|---|---|---|
| 1394398 | 2/1965 | France | 70/167 |

*Primary Examiner*—Roy D. Frazier
*Assistant Examiner*—Peter A. Aschenbrenner
*Attorney, Agent, or Firm*—McAulay, Fields, Fisher & Goldstein

[57] ABSTRACT

A cylindrical money box assembly that is received in a housing through a generally circular opening thereof and has a locking mechanism with a plate that is rotatable to position projecting portions in relation to a set of parts of the housing. In one position of the plate, corresponding to an unlocked state, the projecting portions are located to clear the set of housing parts allowing insertion of the money box assembly into the housing, and removal therefrom. In another position of the plate, corresponding to a locked state, the projecting portions engage and interfere with the set of housing parts to securely lock the money box assembly to the housing.

9 Claims, 11 Drawing Figures

CYLINDRICAL MONEY BOX ASSEMBLY

BACKGROUND AND SUMMARY OF THE INVENTION

This invention relates in general to a coin operated control device, and, more particularly, to a money box assembly for the coin operated control device.

The typical coin-control device for a coin operated appliance has a coin slide mechanism which is generally operatively connected to a timer and switches to set appliance into a prescribed cycle of operation upon deposit of a specified coin or coins. The deposited coins are accumulated in a locked money box for subsequent removal by an authorized person.

In the prior art, as exemplified by U.S. Pat. No. 3,927,750, the coin slide mechanism and money box are received in a common housing structure, with the money box being in a position to receive coins from the coin slide mechanism. The money box of the subject invention also is utilized in the same general way with an associated coin slide mechanism and housing.

Prior art money boxes have square or rectangular front door shapes which present corners that are vulnerable to prying and tampering, and therefore make the money box subject to theft. To provide a money box that is more theft and tamper resistant, the invention offers a money box assembly that is generally cylindrical in configuration and has a generally circular front plate or door. The money box assembly is used in a housing enclosure or vault with a matching circular opening, and can only be installed in one position where it is locked in place by turning a key, for approximately 45 degrees. Rotation of the money box assembly is prevented by means of a small radial notch and a flat section on the circumference of the front door plate, which notch and flat section interlock with matching configuration parts defining the enclosure opening.

In general, the invention provides a money box assembly that is received in a housing through a generally circular opening thereof, the departure from circular shape being due to the notch and flat section. The assembly has a locking mechanism with a plate that is rotatable to position projecting wing portions in relation to a set of wing parts of the housing. In one position of the plate, corresponding to an unlocked state, the plate wing portions are located to clear the set of housing wing parts allowing insertion of the money box assembly into the housing and removal therefrom. In another position of the plate, corresponding to a locked state, the plate wing portions engage and interfere with the set of housing wing parts to securely lock the money box assembly to the housing.

For a better understanding of the invention and its various features and advantages, reference should be had to the following detailed description of a preferred embodiment of the invention and the accompanying drawings.

DESCRIPTION OF A PREFERRED EMBODIMENT OF THE INVENTION

Figure 1:
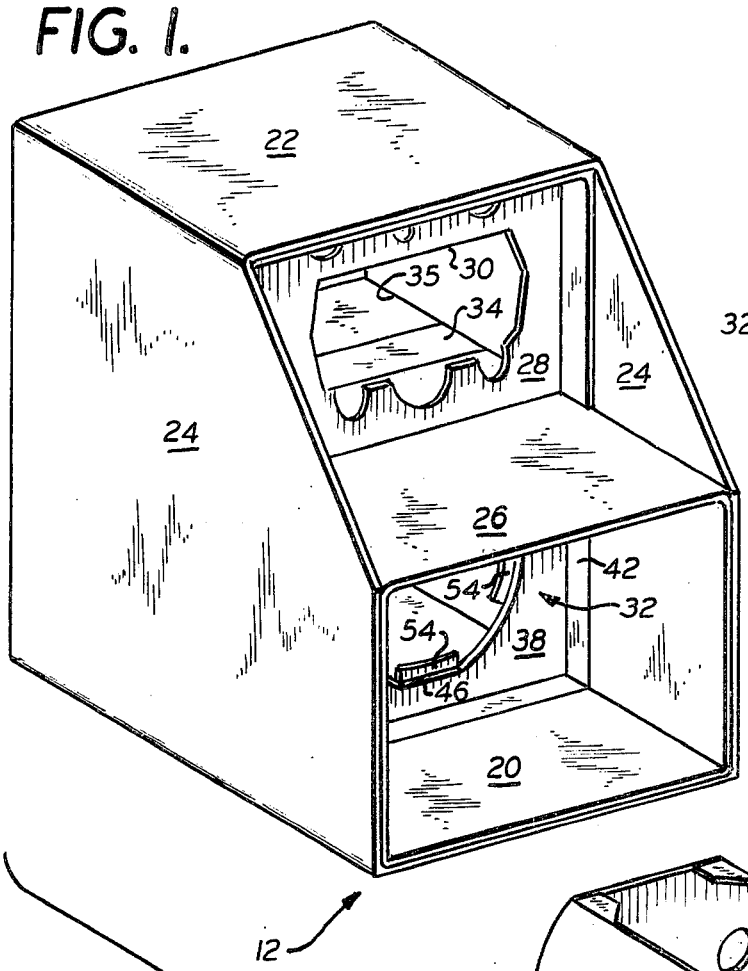
FIG. 1 is a perspective exploded view showing a money box assembly according to a preferred embodiment of the invention in conjunction with a housing for receiving the money box assembly and a typical key used for operating the lock mechanism of the money box assembly.

In FIGS. 1–4, there is exemplified the general concept of a money box assembly 10 of the type which is received in a specially constructed housing 12. Money box assembly 10 itself can be considered basically as the combination of a rather cylindrical, open top, money container 14 that is connected to a front door assembly 16 by a plurality of nut-and-bolt type fasteners 18.

For purposes of example, the housing 12 shown in FIGS. 1–4 is a typical coin-operated control device. Housing 12 is constructed having a bottom wall 20, top wall 22, opposed side walls 24, horizontal patrition 26, and back wall (not shown) joined together to form a two-tier box-like enclosure, as better seen from FIG. 1. At the front, the upper tier of housing 12 is closed by a wall 28 having an opening 30 fitted to receive a coin slide mechanism (not shown). The lower tier of housing 12 is closed at the front by a special wall structure 32, the details of which are given by FIGS. 2, 3 and 4. Within the upper tier of housing 12, there is expediently provided a horizontal baffle 34 formed having an opening 35 to the lower tier of housing 12. When the coin slide assembly is mounted in the housing, the discharge opening of the coin slide extends in overlying relation to an opening 36 formed in the top of container 14 when said money box assembly 10 is installed in said housing. Accordingly, money put in through the coin slide will drop through opening 36 for accumulation in container 14.

Figure 2:
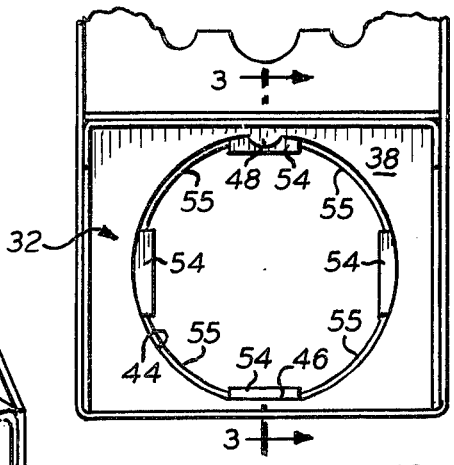
FIG. 2 is a partial front elevational view of the lower portion of the housing shown in FIG. 1, illustrating the opening in the housing for receiving the money box assembly and projecting wings on the housing utilized in conjunction with the lock mechanism of the money box assembly.
Figure 3:
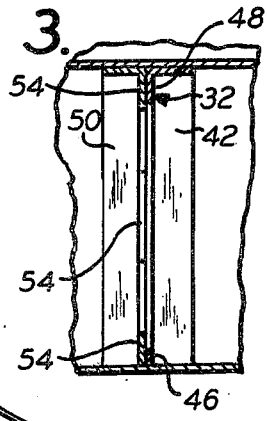
FIG. 3 is a sectional view taken through line 3—3 of FIG. 2.
Figure 3:
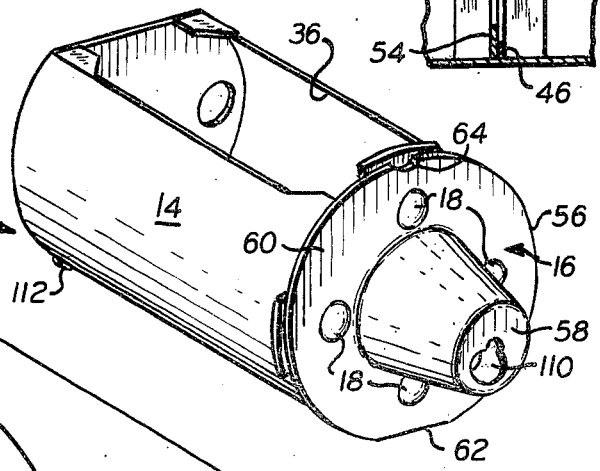
Figures 4, 10, 11:
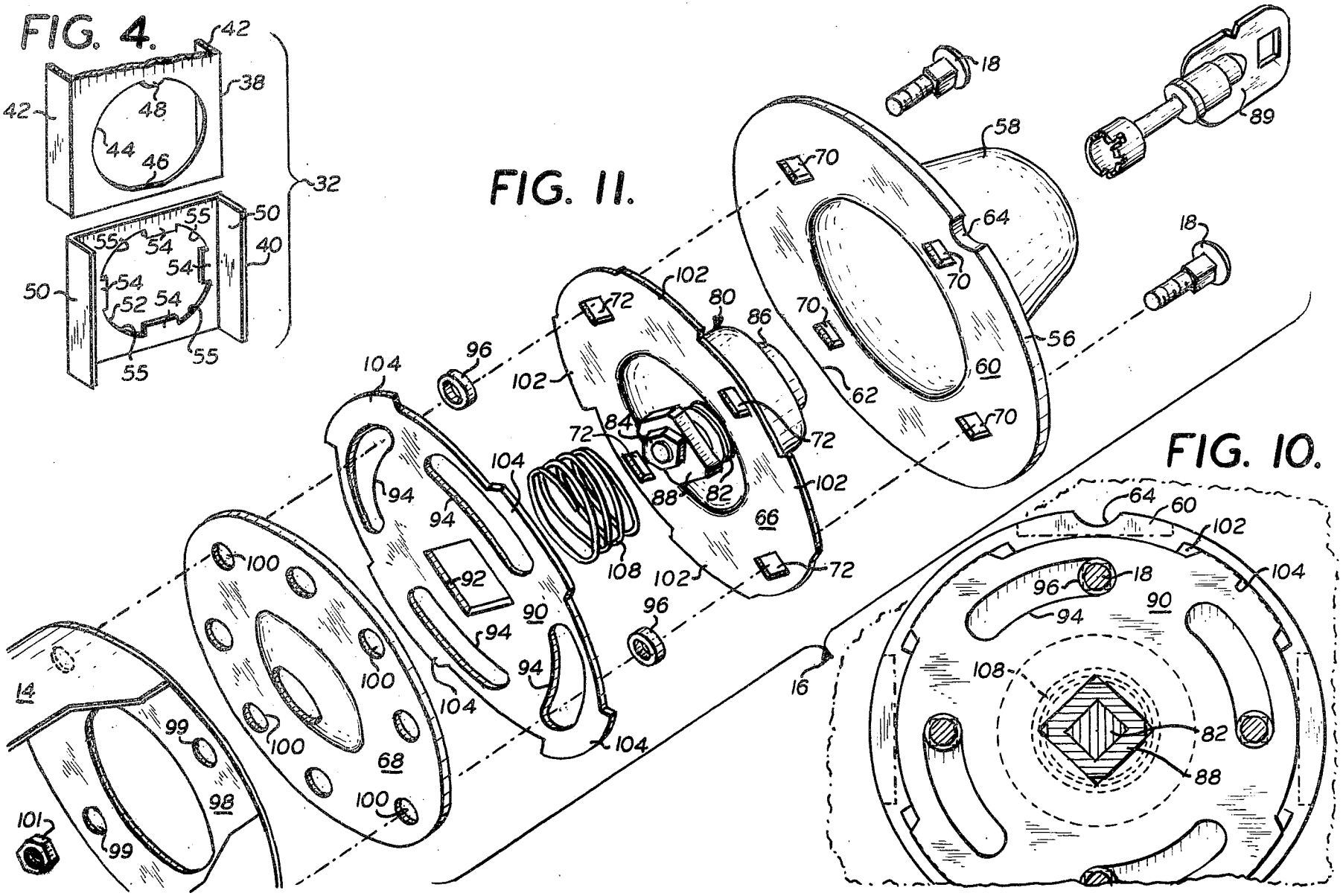
FIG. 4 is a perspective exploded view of wall structure shown in FIG. 3, as seen from the rear of the housing.
FIG. 10 is a sectional view taken through line 10—10 of FIG. 9.
FIG. 11 is a perspective exploded view of the money box illustrating details of its locking mechanism.

Wall structure 32 is expediently made up from two wall pieces 38 and 40 assembled back-to-back as shown in FIGS. 2, 3 and 4. Piece 38 faces the front as installed in housing 12 and has side flanges 42 that are preferrably spot welded to respective adjoining side walls 24 of housing 12. On piece 38 is provided an opening 44 of circular shape except for a flat section 46 and an inwardly projecting tongue 48. Piece 40 faces the back as installed in housing 12 and also has side flanges 50 that are welded to respective adjoining side walls 24 of the housing. Piece 40 has a somewhat different shaped opening 52 bounded by four inwardly projecting wing parts 54 spaced one from the other by arcuately extending edge portions 55.

In accordance with the invention, door assembly 16 carries a locking mechanism with parts that engage the wing parts 54 of the housing 12 to secure the money box assembly 10 in the housing 12. As the door assembly 16 is connected to container 14, the locking mechanism can be considered also as connected to container 14, although as will be explained hereinafter, the door assembly 16 could be used without container 14, to seal wall structure 32.

Figure 5:
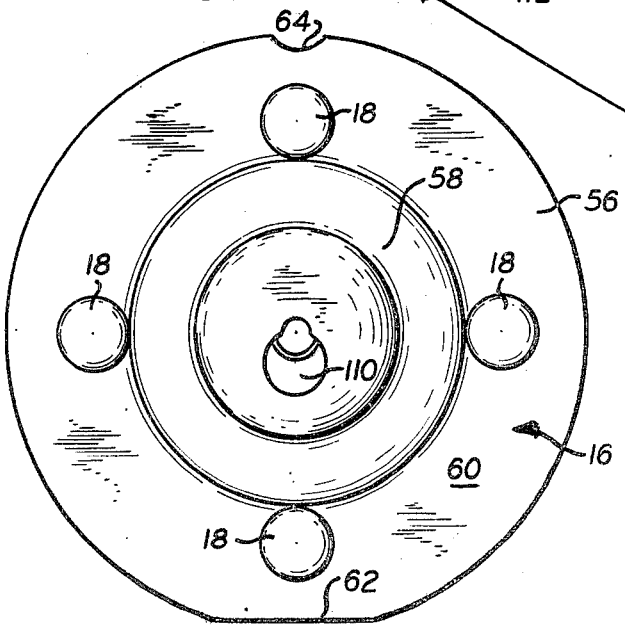
FIG. 5 is a front elevational view of the money box assembly shown in FIG. 1.
Figure 6:
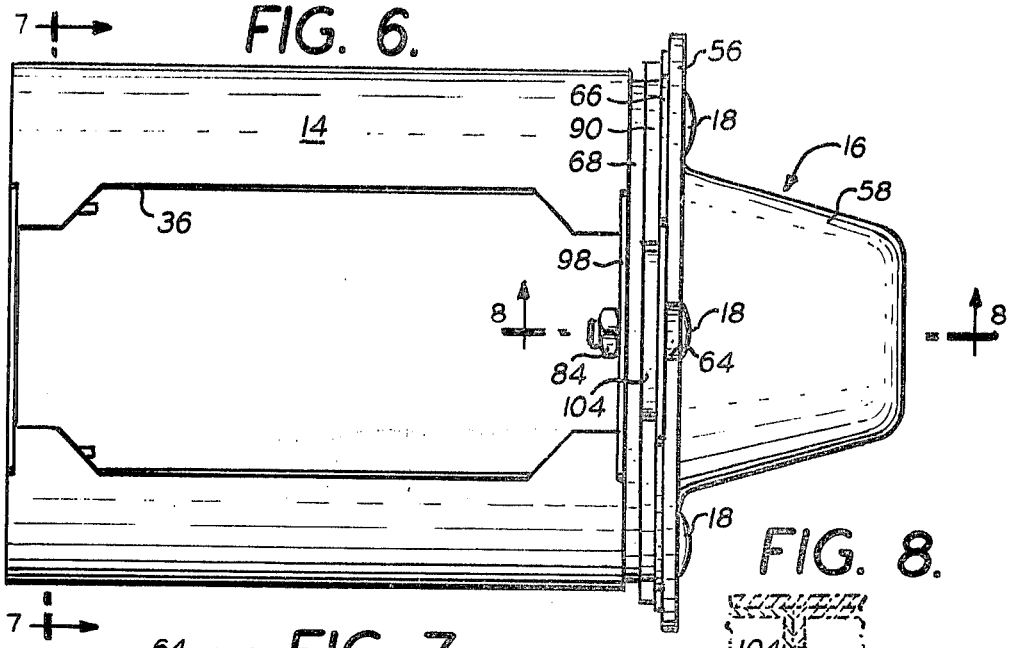
FIG. 6 is a top plan view of the money box assembly as shown in FIG. 5.
Figure 7:
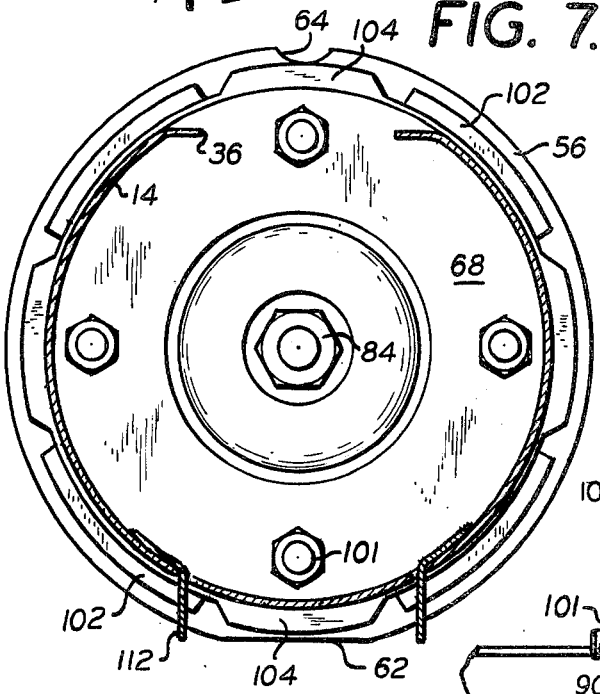
FIG. 7 is a sectional view taken through line 7—7 of FIG. 6, and with the money box assembly in a locked configuration.

Door assembly 16 has a front cover 56 with a central frustoconical cup portion 58 and an outer flange 60. This flange 60 is of generally circular contour and matches the contour of opening 44 on piece 38 such that flange 60 can fit flush into opening 44. For such purpose, there is provided on a flange 60 a flat section 62 matching flat section 46 and a notch 64 that receives tongue 48. FIGS. 5, 6 and 7 illustrate the details of the connection of container 14 to door assembly 16 and the contour of flange 60.

Figure 8:
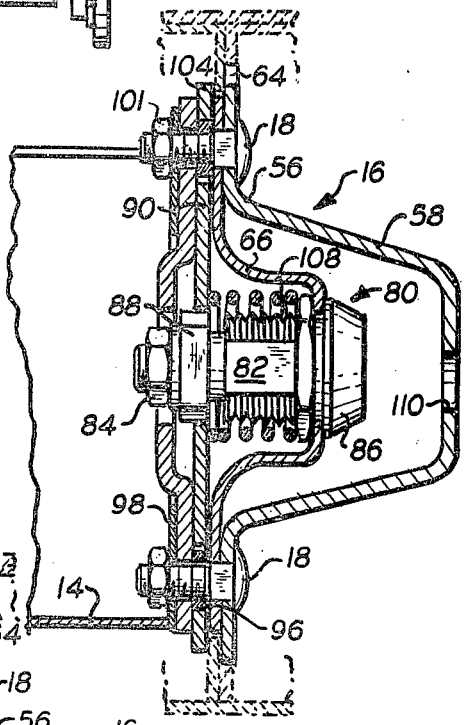
FIG. 8 is a sectional view taken through line 8—8 of FIG. 6, and with the money box assembly in a locked configuration.
Figure 9:
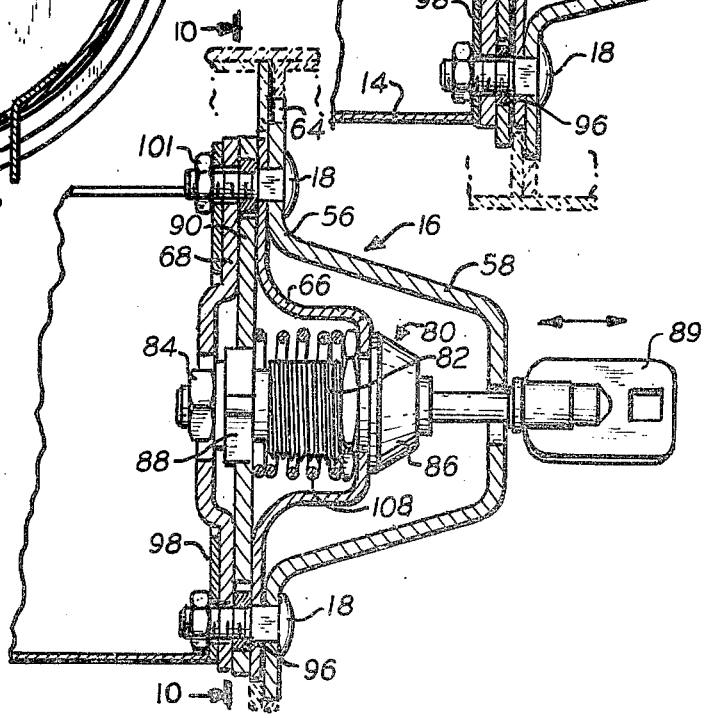
FIG. 9 is a sectional view of the money box assembly taken similar to FIG. 8 but with the money box assembly in an unlocked configuration.

Door assembly 16 and the locking mechanism is best understood by reference to FIG. 11 in conjunction with FIGS. 8, 9 and 10. When the door assembly 16 is received by wall structure 32, the front cover 56 and a lock mount plate 66 and a back plate 68 of said assembly are stationary with respect to housing 12. This is because cover 56, plates 66, 68 and container 14 are secured together by the nut and bolt fasteners 18. Cover 56 fits into opening 44 only in one orientation as established by flat sections 62 and 46, and the tongue 48 and notch 64.

The bolts of fasteners 18 are preferrably of the smooth head type and have square shank portions that match and are received through square holes 70, 72 in cover 56 and plate 66 respectively, such that the nuts of fasteners 18 can be tightened without the shanks thereof turning. For purposes of example, four fasteners 18 are shown, but the actual number can be three or more, as will be apparent to the artisan.

On plate 66 is secured a conventional lock mechanism 80 having a threaded body 82 on which a nut 84 is tightened to clamp plate 66 against the flanged head 86 of lock mechanism 80. A square cam 88 is mounted on threaded body 82 and held in place by nut 84. When the proper key 89 is inserted into lock mechanism 80, as shown in FIG. 9, and key 89 is turned, the square cam 88 rotates between angular limits, typically over a 45 degree travel. Details of a typical lock mechanism 80 can be found in U.S. Pat. No. 3,494,159.

Rotation of cam 88, in turn controls the angular position of a bolt plate 90 which is positioned between lock mount plate 66 and back plate 68. In this regard cam 88 is received in a matching square opening 92 of bolt plate 90. Plate 90 is thus rotatable relative to the stationary plates 66, 68, cover 56 and container 14, for which purpose there are provided four arcuate slots 94 in plate 90, and in which slots ride respective bushings 96 on the threaded shank portions of the corresponding fasteners 18. Accordingly, the slots 94 and bushings 96 guide the limited rotary movement of plate 90 about a central axis.

In a typical installation, back plate 68 abuts against plate 90 and against the front face 98 of container 14. Face 98 is expediently in the form of a ring plate having a plurality of circumferentially spaced openings 99 which are disposed in alignment with similar openings 100 formed in back plate 68. In assembly, the threaded ends of fasteners 18 pass through the holes in said back plate and ring plate and receive nuts 101 which serve to secure the door assembly 16 to container 14.

As more easily noted from FIGS. 8 and 9, when the money box assembly is installed in housing 12, the flange 60 is generally flush with piece 38 of the wall structure 32 and plate 66 is generally flush with piece 40 thereof. For such purpose, plate 66 has a peripheral contour that fits within the opening 52 of piece 40, and on which plate 66 are four projecting wing parts 102 that fit into the arcuate spaces 55 between the wing parts 54 on piece 40. This adds strength to the door assembly 16 since wing parts 54 and 102 would interfere to prevent twisting of the door assembly 16.

Bolt plate 90 thus is in a plane behind that of the housing wing parts 54. To perform the functions of locking and unlocking door assembly 16 to wall structure 32, plate 90 has four projecting wing parts 104 and a peripheral contour shaped to pass through the opening 44 in piece 38 regardless of the angular position of plate 90, but which will pass through the opening 52 in piece 40 only when plate 90 is in an angular position, such as shown by FIG. 10, wherein wing parts 104 are aligned with arcuate spaces 55 and do not interfere with the housing wing parts 54. In such position, wing parts 104 will partially overly corresponding wing parts 102 of plate 66.

Thus, the invention provides in door assembly 16, and for money box assembly 10, a locking mechanism having bolt plate 90 with projecting wing parts 104, which plate 90 is rotatable between a first position corresponding to an unlocked configuration, as shown in FIGS. 9 and 10, and a second position, as shown in FIG. 8, corresponding to a locked configuration. When plate 90 is in the first, or unlocked position, its wing parts 104 are so located as to clear the set of wing parts 54 of housing 12, thereby allowing insertion of the money box assembly 10 (and particularly door assembly 16 thereof), into the housing 12, and removal therefrom when it is desired to gain access to the money box. When plate 90 is in the second, or locked position, its wing parts 104 are so located as to overlap, and thereby engage and interfere with the set of housing wing parts 54, to securely lock door assembly 16, and hence the money box assembly 10, to the housing 12.

The arcuate slots 94 are therefore limited in circumferential length so that when the bushing 96 abuts one end of a respective slot 94, plate 90 is in one of the aforementioned first and second positions, and when such bushing 96 abuts the opposite end of the slot 94, plate 90 is in the other of these positions.

For less criticality of fit, a spring 108 is provided in door assembly 16 so that bolt plate 90 is spring loaded against the back plate 68. This has been found to give a smoother locking action of the wing parts 104 and eliminates rattling. The degree of play or looseness of the locking mechanism can of course be adjusted by tightening or loosening the nuts of fasteners 18, as desired.

Front cover 56 preferrably has a hardened cone portion 58 to resist forced entry, and also has a carefully sized, key insertion opening 110 that is offset with respect to the lock mechanism 80 key opening, to keep out tampering tools.

A cylindrical shape money container has been found to be advantageous, as it allows for an improved coin distribution without excess pile-up, as compared to a square or rectangular tray of similar size. The remote end of money container 14 preferrably has two legs 112 that permit container 14 to be rested on a flat surface without tipping over when it is removed from the housing.

As will be appreciated by the artisan, the container 14 is in many cases attached to door assembly 16 to form an integrated money box assembly 10. However, the container 14 could be eliminated and door assembly 16 used in the same functional manner merely as a lockable access cover to the lower tier of housing 12. However, it it preferred that the container 14 be connected to door assembly 16 thereby permitting the collected money to be removed along with the door assembly 16.

While a preferred embodiment of the invention has been shown and described in detail, it will be readily understood and appreciated that numerous omissions, changes and additions may be made without departing from the spirit and scope of the invention.

What is claimed is:

1. A money box assembly of the type which is received in a housing and has a locking mechanism with parts that engage parts of the housing to secure the money box assembly in said housing, which money box assembly comprises a container for receiving money deposited, and a locking mechanism connected to said container, said locking mechanism having a plate with projecting portions, said plate being rotatable between a first position corresponding to an unlocked configuration and a second position corresponding to a locked configuration, said projecting portions being located to clear a predetermined set of spaced-apart wings of a housing and allow insertion of the money box assembly into such housing for reception thereby and removal of the money box assembly from the housing when said plate is in the first position, said projecting portions being located to engage and interfere with said set of wings of the housing to securely lock the money box assembly thereto when said plate is in the second position; and said locking mechanism further having a stationary plate with projecting wings that fit in between the spaced-apart wings of said housing to prevent rotation of the money box assembly relative to the housing.

2. A money box assembly according to claim 1 wherein said locking mechanism includes a lock having a cam rotatable by turning a key that fits said lock, and portions of said rotatable plate disposed for engagement with said cam for rotating said plate thereby.

3. A money box assembly according to claim 1 including a cover plate having a contour matching the contour of an opening in the housing to allow reception of the money box assembly in the housing only with said cover plate in a predetermined orientation with respect to said opening.

4. A money box assembly according to claim 1 wherein said rotatable plate has arcuate slots and including members received through said slots and cooperating therewith to guide the rotary movement between said first and second positions, said slots having circumferential lengths corresponding to the angular distance between said first and second positions.

5. A money box assembly according to claim 1 wherein said container has leg means disposed to maintain the container in an upright attitude when the money box assembly rests on a horizontal surface.

6. A money box assembly according to claim 1 wherein the projecting portions of said rotatable plate are in the form of a plurality of projecting wings that overlay the projecting wings of said stationary plate when the rotatable plate is in said first position.

7. In a lockable closure assembly of the type that is received in a housing and has a locking mechanism with parts that engage parts of the housing to secure the closure assembly thereto, the improvement which comprises said locking mechanism having a plate with projecting portions, said plate being rotatable between a first position corresponding to an unlocked state and a second position corresponding to a locked state, said projecting portions being located to clear a predetermined set of spaced-apart wings of a housing and allow insertion of the closure assembly into a received condition with the housing and removal of the closure assembly from such received condition when said plate is in the first position, said projecting portions being located to engage and interfere with said set of wings of the housing to securely lock the closure assembly thereto when said plate is in the second position; and said locking mechanism further having a stationary plate with projecting wings that fit in between the spaced-apart wings of said housing to prevent rotation of the closure assembly relative to the housing.

8. The improvement according to claim 7 wherein said locking mechanism includes a lock having a cam rotatable by turning a key that fits said lock, and portions of said rotatable plate disposed for engagement with said cam for rotating said plate thereby.

9. The improvement according to claim 7 including a cover plate on said closure assembly having a contour matching the contour of an opening in the housing to allow reception of the closure assembly by the housing only with the cover plate in a predetermined orientation with respect to the housing.

* * * * *